United States Patent [19]

Guerro

[11] Patent Number: 5,026,405

[45] Date of Patent: Jun. 25, 1991

[54] BOND FOR ABRASIVE TOOLS

[75] Inventor: Gerald J. Guerro, Trumbull, Conn.

[73] Assignee: American Cyanamid Company, Stamford, Conn.

[21] Appl. No.: 468,314

[22] Filed: Jan. 22, 1990

[51] Int. Cl.[5] ..... C09K 3/14

[52] U.S. Cl. ..... 51/298; 534/751

[58] Field of Search ..... 51/298; 534/751

[56] References Cited

U.S. PATENT DOCUMENTS

| | | | |
|---|---|---|---|
| 4,126,428 | 11/1978 | Reder | 51/298 |
| 4,221,572 | 9/1980 | Torimae et al. | 51/298 |
| 4,226,602 | 10/1980 | Fukuda | 51/298 |
| 4,239,503 | 12/1980 | Harris et al. | 51/298 |
| 4,246,004 | 1/1981 | Busch et al. | 51/298 |
| 4,331,453 | 5/1982 | Dau et al. | 51/298 |
| 4,333,743 | 6/1982 | Nojima | 51/298 |
| 4,386,943 | 6/1983 | Gümbel et al. | 51/298 |
| 4,553,982 | 11/1985 | Korbel et al. | 51/298 |

*Primary Examiner*—William R. Dixon, Jr.
*Assistant Examiner*—Willie J. Thompson
*Attorney, Agent, or Firm*—Roger S. Benjamin

[57] ABSTRACT

In the phenolic bond used for making abrasive tools such as grinding wheels and the like, the addition of certain alkyl or hydroxyalkylcarbamylmethyl triazines improves wet strength properties of the tools.

7 Claims, No Drawings

BOND FOR ABRASIVE TOOLS

The invention relates to improvements in rigid abrasive tools, for example grinding wheels, bonded with organic polymer bond. More particularly the invention relates to new bond compositions for reducing the loss of mechanical strength when such abrasive tools are wet.

We have found that certain curable compositions comprising triazine compounds more particularly defined below, when incorporated in the composition of rigid grinding tools during manufacture can reduce the characteristic deterioration of mechanical strength when the abrasive tool is wet. Phenolic resins are the principal ingredient of bonds most widely used for making grinding tools of bonded abrasive grain. Other organic polymer bonds that are sometimes used include heat-curable resins such as shellac and alkyd resins. Novolac phenolic resins are usually used as powders which include the novolac resin and a curing agent. Powdered hexamethylene tetramine is the curing agent used most widely but other powder or liquid curing agents may be used instead, such as aldehydes, trimethylol phenol, resole phenolic resins and the like. Many formulations for abrasive tool bonds based on thermosetting resins such as phenolics have been described. Many variations of such formulations are known for making tools having a variety of mechanical properties and grinding characteristics.

One problem that is generally characteristic of abrasive tools bonded with organic polymer bond is loss of mechanical strength when wet. An object of the invention is to provide new ingredients in thermosetting bond compositions which can reduce the loss of mechanical strength of bonded abrasive tools when wet.

U.S. Pat. Nos. 4,708,984 and 4,710,542 described curable compositions comprising:

(a) an active hydrogen-containing material; and (b) a triazine composition selected from (i) compounds of the formulas

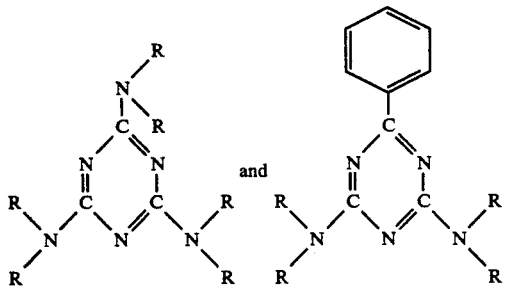

wherein at least two R groups are $-CH_2NHCOOR^1$ wherein $R^1$ is selected from alkyl having 1–20 carbon atoms, and beta-hydroxyalkyl having 2–18 carbon atoms, and the remainder, if any, of R groups are $CH_2OR^2$ wherein $R^2$ is hydrogen or alkyl having 1–12 carbon atoms; and (ii) mixtures of the above defined compounds, oligomers of the above defined compounds and mixtures of such compounds with such oligomers; and (c) a cure catalyst.

Other triazine compounds of the structural formulas shown above, wherein at least two R groups are $-CH_2CH_2CHCOOR^1$ wherein $R^1$ is alkyl having 1–20 carbon atoms or betahydroxyalkyl having 2 to 10 carbon atoms, and the remainder, if any, of R groups are selected from Cl, Br, 1 or alkoxy having 1 to about 6 carbon atoms, and the synthesis of such other triazine compounds, as well as oligomers thereof and mixtures of such compounds or mixtures of such compounds and oligomers, were described in U.S. Pat. No. 4,742,118.

Triazine compositions of the class described above are used in accordance with the present invention as additives in improved bond compositions for making abrasive articles. The principal component of the curable bond composition is a thermosetting curable organic resin, preferably a curable phenolic resin. At least part of the bond formulation is one or more of the triazine compositions of the class defined above, preferably comprising at least one compound in which at least some of the $R_1$ components are beta hydroxyalkyl. A most preferred triazine compound for use in the invention is $C_3N_6(CH_2NHCOOC_3H_8OH)_6$.

A cure catalyst is incorporated with the triazine composition in bond compositions of the invention. Salts or complexes of metals such as lead, zinc, iron and manganese and preferably tin or titanium can be used. Organic salts such as acetates, octoates, laurates and naphthenates are preferred salts. Complexes such as tetrabutyldiacetoxy stannoxane, dibutyltin dilaurate, dimethyltin dilaurate and acetyl acetonates can also be used. Chelates of titanium With acetylacetone, ethylacetoacetate, triethanolamine, lactic acid and the like can be used. Also, quaternary ammonium compounds, e.g. tetramethylammonium hydroxide can be used. These catalysts are used in amounts effective to accelerate cure at the same temperatures that are used for curing the phenolics, usually above 100° C. An amount of cure catalyst in the range from 0.1 to 2% by weight based on total weight of the organic binder composition is suitable in most cases.

The abrasive material in the bonded abrasive articles of the invention may be any particulate abrasive material that is suitable for the use, such as particles ranging in size from fine powders to coarse grits, of either natural abrasives such as diamond, corundum, emery, feldspar, quartz, and the like or manufactured abrasives such as silicon carbide, various aluminas, zirconia, boron nitride, glass, steel wool, angular grit, iron shot, etc.

In a thermosetting bond composition according to the invention, the essential resin ingredients of the bond are a thermosetting resin, preferably a phenolic resin with a curing agent, and a triazine compound of the formula described above with a cure catalyst. Of the resin components in the bond composition, the thermosetting resin, e.g. the phenolic resin with curing agent, will constitute the major resin component of the bond, such as 60 to 95%, preferably from about 80% to 95% by weight of the total resin content. In preferred embodiments, the major phenolic component is a novolac with its curing agent, together constituting from 75% to 100% of the total phenolic content, any remaining phenolic being a resole phenolic resin. The other essential resin component, in addition to the thermosetting resin, is the triazine composition with its cure catalyst. In preferred embodiments of the invention the triazine compound and its cure catalyst together constitute 5 to 40% and preferably from about 5% to about 20% by weight of the total resin in the bond composition. In addition to the resins which may include curing agents and cure catalyst, the bond composition may also include fillers which may constitute up to 30% by weight of the total bond composition, and the bond may also include minor amounts of other additives.

Preferred mixtures of abrasive and bond for making cured abrasive tools embodying the invention comprise abrasive material constituting about 60% to 90% by weight of the mixture. This mixture further comprises a thermosetting resin bond composition of the kind described above, constituting about 10% to 40% by weight of the total abrasive and bond mixture.

The composition of the abrasive article may include other ingredients in addition to the abrasive and bond components, such as wetting agents, fillers, modifiers, lubricants and the like. Abrasive articles incorporating the invention are bonded abrasive products such as wheels, discs, sticks, blocks, cones and the like.

In our presently most preferred mode of carrying out the invention, described in more detail in examples below, we make a bonded abrasive article comprising abrasive grains bonded with a bond formulation which comprises novolac phenolic resin with a curing agent and a mixture of triazine compounds and oligomers obtained by the the reaction described in Example 8 of U.S. Pat. No. 4,708,984. This mixture is a liquid mixture of hydroxypropylcarbamylmethylated melamines. It contains about 30 to 40 percent by weight of the triazine compound of the formula $$C_3N_6(CH_2NHCOOC_3H_8OH)_6$$

A cure catalyst is added to the triazine composition.

The invention is described in more detail below by reference to specific examples embodying the invention.

EXAMPLE 1

To 91.9 parts by weight of abrasive grains of fused alumina is gradually added 1.13 parts by wt of a liquid pick up agent described below. The liquid and powder are mixed for about 5 minutes until the abrasive powder is uniformly wet with the liquid solution. Then 7.0 parts of novolac phenolic resin powder which has been premixed with a curing amount of hexamethylenetetramine is added and thoroughly mixed with the wet abrasive powder for about 15 minutes until the wet abrasive powder has picked up the resin powder. This mix is aged for about 18 hours at room temperature and then is compressed in an AFS core box assembly using a Dietert No. 315 Sand Rammer to make 25.4 mm thick AFS test specimens for tensile strength testing.

The specimens are cured at temperature which is gradually increased to 175° C. over a period of 9 hours. The cured specimens are tested for dry tensile strength at break by a standard test method, taking care to maintain uniformity in details of preparation, treatment and handling of the samples and uniformity of conditions for the test.

To test for wet strength, specimens identical to those used in the dry tensile strength test are immersed in water for ten days then removed and immediately tested for tensile strength at break by the same test method. Results of the wet and dry tensile strength tests are shown in Table 1.

Several different mixtures of abrasive and bond are prepared and formed into test specimens as described, but using several different liquid compositions as the liquid pick up agent.

For specimens identified as Specimen A, the liquid pick up agent is composed of:

(i) 1.07 parts by weight of the mixture of triazine compounds and oligomers obtained by the the reaction described in Example 8 of U.S. Pat. No. 4,708,984, which comprises about 30 to 40 wt % of the compound $$C_3N_6(CH_2NHCOOC_3H_8OH)_6,$$

and dissolved in an aqueous 70% solution with (ii) 0.06 parts by weight of cure catalyst which is DABCO-TMR, a quaternary ammonium salt in ethylene glycol.

For control specimens, the mix of abrasive and bond is prepared the same as those described above except the liquid pick up agent consists of a liquid resole phenolic resin in aqueous solution instead of the liquid hydroxyalkylcarbamylmethylated melamines and oligomers.

Results of the tensile strength tests of the control specimens and the test specimens A and B, described above are tabulated in Table 1.

TABLE 1

| | Tensile Strength at Break Pounds per square inch | | |
|---|---|---|---|
| Specimen | Dry | Wet | Percent Loss on Wetting |
| Control | 1470 | 840 | 43% |
| A | 1080 | 840 | 22% |

Results in Table 1 demonstrate the advantage that the loss of tensile strength on wetting samples made with the triazine compound additive is only about half the loss of strength on wetting of the control made without triazine. Although the control has higher dry strength, the strengths of the wet samples are about the same.

We claim:

1. In an abrasive tool comprising abrasive grains bonded with thermosetting resin bond, the improvement wherein the thermosetting resin bond composition comprises 5 to 20 weight percent based on total resin content, of (a) a triazine composition selected from (i) compounds of the structural formulas

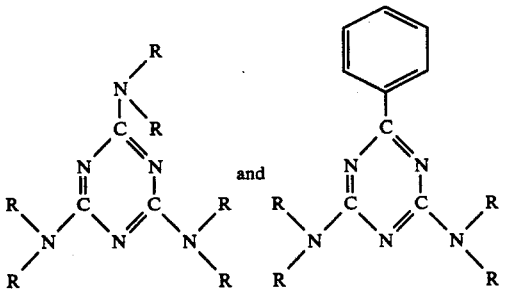

wherein at least two R groups are $CH_2NHCOOR^1$ wherein $R^1$ is selected from alkyl having 1–20 carbon atoms, and beta-hydroxyalkyl having 2–18 carbon atoms, and the remainder, if any, of R groups are $CH_2OR^2$ wherein $R^2$ is hydrogen or alkyl having 1–12 carbon atoms; and (ii) mixtures of the above defined compounds, oligomers of the above defined compounds and mixtures of such compounds with such oligomers; and (iii) compounds of the structural formulas shown above wherein at least two R groups are $CH_2CH_2NHCOOR^1$ wherein $R^1$ is alkyl having 1–20 carbon atoms or beta-hydroxyalkyl having 2–10 carbon atoms, and the remainder, if any, of R groups are selected from Cl, Br, I, and alkoxy having 1 to 6 carbon atoms, including oligomers and mixture of such compounds, and (b) a cure catalyst.

2. An improved abrasive tool defined by claim 1 wherein the thermosetting resin bond composition further comprises from 80 to 95 percent by weight, based on total resin content, of phenolic resin.

3. An improved abrasive tool defined by claim 1 wherein the triazine composition comprises a triazine compound of the class defined, wherein at least two R groups in the structural formulas shown are $CH_2NHCOOR^1$ wherein $R^1$ is betahydroxypropyl.

4. An improved abrasive tool defined by claim 3 wherein the selected triazine compound is $C_3N_6(CH_2COOC_3H_8OH)_6$.

5. An improved abrasive tool defined by claim 4 wherein the phenolic resin is novolac phenolic resin with a curing agent.

6. A resin composition comprising 5 to 40 percent by weight based on total resin content, of (a) a triazine compound selected from (i) compounds of the formula

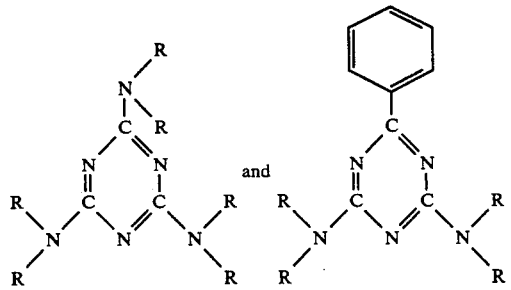

wherein at least two R groups are $CH_2NHCOOR^1$ or $CH_2CH_2NHCOOR^1$ wherein $R^1$ is selected from alkyl having 1–20 carbon atoms, and beta-hydroxyalkyl having 2–10 carbon atoms, and the remainder, if any, of R groups are $CH_2OR^2$ wherein $R^2$ is hydrogen or alkyl having 1–12 carbon atoms; and (ii) mixtures of the above defined compounds, oligomers of the above defined compounds and mixtures of such compounds with such oligomers; and (b) a cure catalyst; and 60 to 95 percent by weight based on total resin content, of a phenolic resin.

7. A resin composition defined by claim 6 wherein the phenolic resin is novolac phenolic resin with a curing agent.

* * * * *